US007399938B2

(12) United States Patent
Glasson

(10) Patent No.: US 7,399,938 B2
(45) Date of Patent: Jul. 15, 2008

(54) SWITCH WITH LOW PRE-TRAVEL AND HIGH OVERTRAVEL

(75) Inventor: Richard Glasson, Whippany, NJ (US)

(73) Assignee: Control Products Inc, East Hanover, NJ (US)

( * ) Notice: Subject to any disclaimer, the term of this patent is extended or adjusted under 35 U.S.C. 154(b) by 0 days.

(21) Appl. No.: 11/451,193

(22) Filed: Jun. 12, 2006

(65) Prior Publication Data

US 2007/0284232 A1 Dec. 13, 2007

(51) Int. Cl.
*H01H 13/00* (2006.01)
*H01H 3/00* (2006.01)

(52) U.S. Cl. ..... 200/329; 200/520; 200/341

(58) Field of Classification Search ..... 200/329
See application file for complete search history.

(56) References Cited

U.S. PATENT DOCUMENTS 4,095,070 A 6/1978 Simpson
4,965,420 A 10/1990 Phillips et al.
5,302,789 A * 4/1994 Hellman et al. ..... 200/461
5,359,163 A 10/1994 Woodard
5,574,265 A 11/1996 Falcon
6,100,483 A * 8/2000 Horie et al. ..... 200/437
6,717,085 B2 * 4/2004 Wang ..... 200/520
6,791,038 B1 * 9/2004 Lai ..... 200/16 A
6,861,604 B2 3/2005 McSwiggen

OTHER PUBLICATIONS

Honeywell, Micro Switch Sensing and Control, Basic Switches Auxiliary Actuators Standard Basic, Created Dec. 20, 1996, Modified Mar. 5, 1996. Obtained from http://www.flamecorp.com/pdf_files/actuators_13.pdf.
Sacramento Electronic Supply, Sacramento Electronics : Product Detail, Micro Switch : Basic Pin Plunger, http://stores.sacelec.com/sacramentoelectronics/detail.jsp?name=B27RQT, Apr. 6, 2006.

* cited by examiner

*Primary Examiner*—Elvin Enad
*Assistant Examiner*—Lheiren Mae A Anglo

(57) ABSTRACT

A low-profile robust switch having low pre-travel and high overtravel is provided through the use of counteracting biasing elements that operate upon the actuating area of the switch in the absence of externally applied forces. These biasing elements set the switch very close to its actuation point. In the disclosed embodiments, these counteracting biasing elements include a lever and at least one spring which are arranged to provide a low-profile switch.

13 Claims, 3 Drawing Sheets

100

SWITCH WITH LOW PRE-TRAVEL AND HIGH OVERTRAVEL

TECHNICAL FIELD

The present invention relates to a robust electrical switch having low pre-travel and high overtravel. In particular, this application is related to co-pending U.S. application Ser. No. 11/473,655 entitled "Device limit switch with low pre-travel and high overtravel," filed on Jun. 23, 2006.

BACKGROUND OF THE INVENTION

Pre-travel and overtravel are two commonly specified requirements for a switch. Pre-travel is the amount of movement of the switch actuator mechanism before switch changes its electrical state, i.e., the electrical state between the terminals of the switch changes. The electrical state between a pair of switch terminals is typically either an electrical open circuit or a short circuit. Overtravel is the amount of movement that the switch actuator is designed to accommodate after the switch changes state. The sum of pre-travel and overtravel is the total travel of the switch actuator.

The rise of terrorism in the world has created the need to secure and protect activities of a general commercial nature. One such need is that of securing shipping containers against unauthorized opening after the container has been readied and sealed for shipment. Electronic systems that utilize electrical switches are being designed to track and monitor containers with respect to unauthorized opening as the containers are in transit to their respective destinations. As there is a large embedded base of shipping containers, the switches for this application must be compatible with existing container designs and must be capable of withstanding rough treatment and operate flawlessly with different containers having rather large part tolerances. In one proposed application, it is contemplated that a door switch be mounted on each shipping container between the small space between the door and door jamb. For this application, the switch must be robust and possess particular pre-travel and overtravel requirements. While electrical switches exist in a myriad of shapes, sizes, and designs, no existing switch exists that can met the requirements of the shipping container application. Accordingly, providing a door switch for a system designed to detect unauthorized opening of shipping containers would be desirable.

SUMMARY OF THE INVENTION

Broadly, the present invention relates to a low-profile switch having low pre-travel and high overtravel. Advantageously, this switch is suitable for use in systems for tracking and monitoring shipping containers. In order to meet rather stringent pre-travel and overtravel requirements, the switch utilizes an actuator that moves in response to an external force and, in turn, causes the switch to change its electrical state. The actuator engages with elements that operate on an internal switch element having a plurality of terminals and an actuating area. The application of forces to this actuation area causes the electrical states between the terminals of the switch to change. In accordance with the present invention, the switch incorporates elements that provide opposing biasing forces with respect to the actuation area so that the switch provides "hair trigger" actuation. Specifically, a first element incorporating a lever is disposed over the actuating area of the switch and provides a first biasing force sufficient to cause the switch to change state. In the absence of an external force applied to the switch actuator, the first biasing force supplied by the first element is opposed by a second biasing force provided by a second element. Preferably, to reduce the switch profile, the second element is offset from the first element. The application of external forces sufficient to provide very slight actuator movement, removes the opposing biasing force provided by the second element and the switch responds to the biasing provided by the first element and changes state. In one embodiment of the present invention, the lever of the first element is configured to act as a spring so as to supply the first biasing force. In another embodiment of the present invention, a spring element acts on the lever to provide the first biasing force.

DETAILED DESCRIPTION OF THE INVENTION

A low profile, low pre-travel and high overtravel switch in accordance with the present invention is designed to preclude unauthorized tampering with a shipping container after it has been readied for shipment. In this application, the door switch is mounted to the container on its door frame and is actuated by the movement of the container door so that after the door is closed and the container is secured, even the slightest opening of the door causes the switch to change state and trigger an alarm. The alarm could be audible, visible, or a combination of both and the alarm could sound either proximate to the container that had been tampered with or at a monitoring location far removed from the container.

Figure 1:
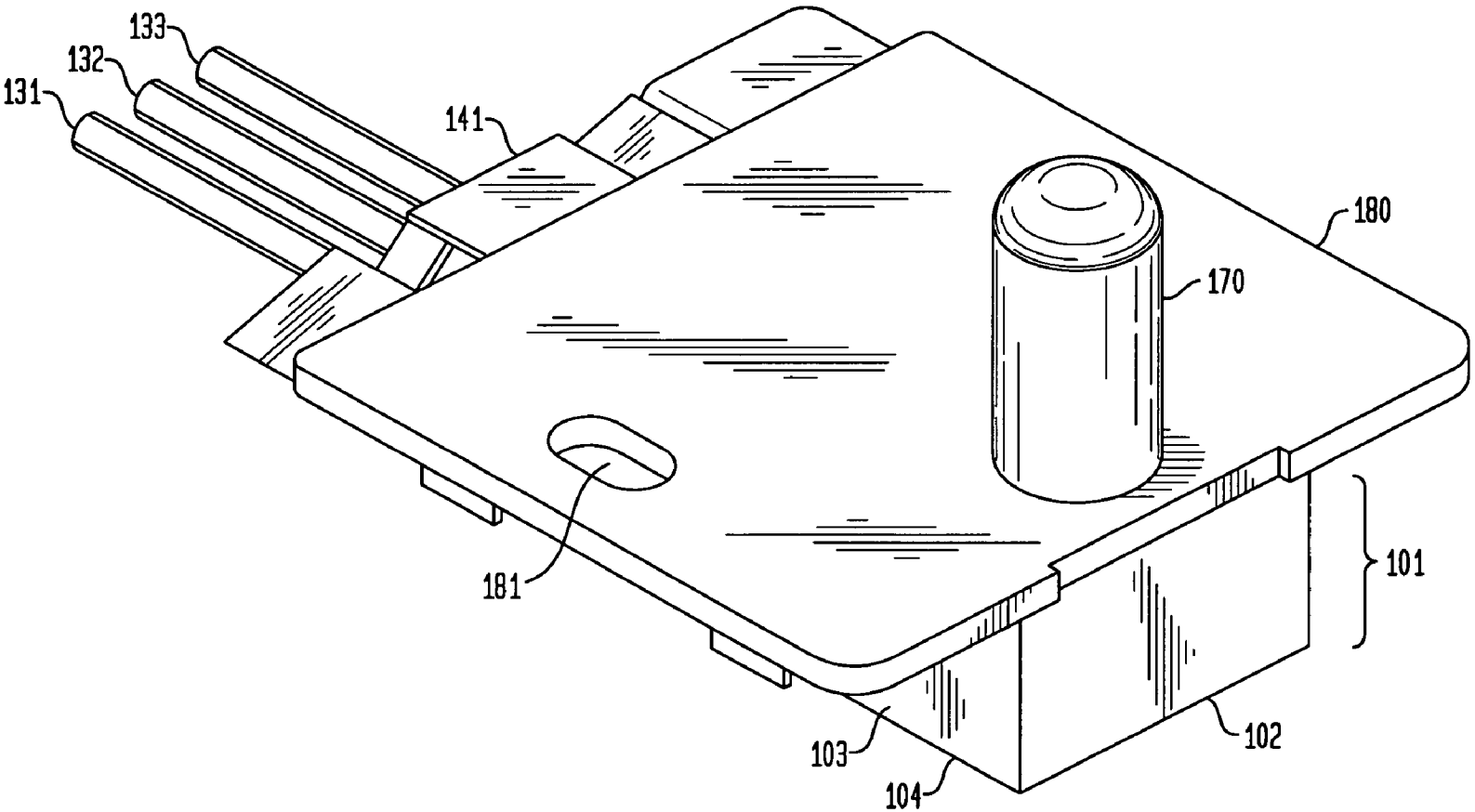
FIG. 1 is a perspective view of an assembled switch in accordance with an embodiment of the present invention.
Figure 2:
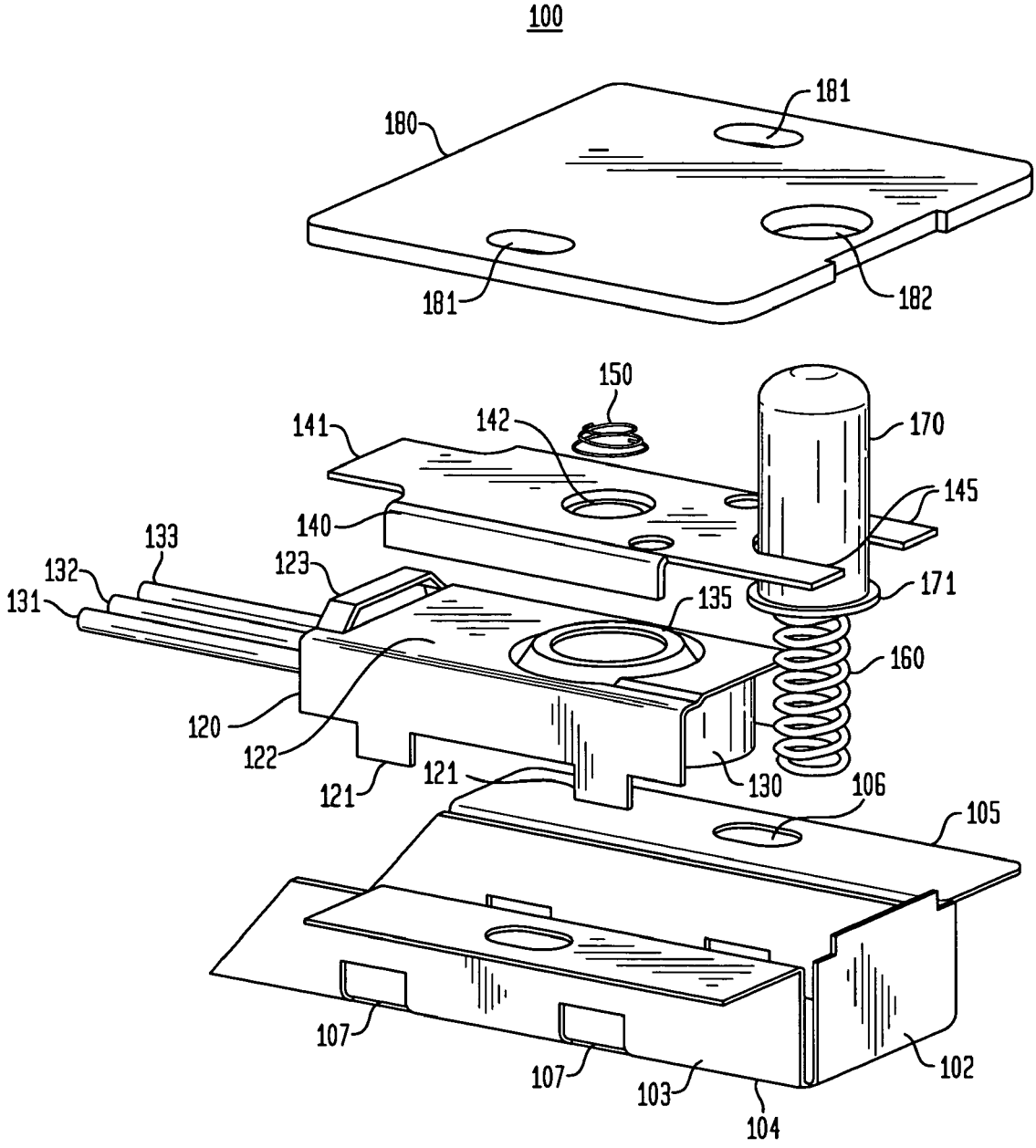
FIG. 2 is an exploded perspective view of the internal elements of the switch shown in FIG. 1 in accordance with a first embodiment of the present invention.

FIG. 1 shows a first embodiment of an assembled switch 100 in accordance with the present invention. The internal elements of this switch in accordance with the preferred embodiment of the present invention are shown in FIG. 2. Referring to FIGS. 1 and 2, switch 100 includes a housing 101, switch element cover 120, switch element 130, lever 140 and cover 180. In the contemplated shipping container application, the housing and cover of switch 100 are fabricated of stainless steel. However, in other less severe applications, other metals or plastics may be used.

Housing 101 includes an end wall 102, sidewalls 103, bottom 104. Optionally, the housing also includes tabs 105 with holes 106. Cover 180 includes a pair of holes 181 where each of these holes is aligned with a different one of holes 106. Each hole 181 and its associated hole 106 is designed to receive a fastener, such as a screw or rivet, so as to secure cover 180 to housing 101. Cover 180 also includes a hole 182 for receiving plunger 170.

Sidewalls 103 of housing 101 include four apertures 107. Each of these apertures receives a different one of four protrusions 121 on switch element cover 120. Two such protrusions are shown in FIG. 2 and two other protrusions, each aligned with a different one of the protrusions shown in FIG. 2, are in the background and hidden from view. Each protrusion extends through a different aperture 107 in housing 101 and is then bent over to retain the switch cover element within housing 101. Switch element cover 120 is designed to receive and retain a waterproof single-pole, double-throw (SPDT) commercially available switch element 130 between the underside of switch cover plate 120 and the housing bottom 104. Switch element 130 has three leads 131, 132 and 133 which are the conventional normally open, common and normally closed switch leads along with an actuating area 135. While for purposes of this description, switch element 130 is an SPDT element, the present invention may be used with a single pole single throw (SPST) having two leads—common and either normally open or normally closed. Suitable low profile switch elements for use in the present invention include the B7000 series waterproof switches offered by Control Products, Inc. of East Hanover, N.J. Within the B7000 series, those designated as B7113 and B7112 are SPDT and SPST implementations with momentary contacts.

When actuating area 135 of switch element 130 is not depressed, there is an electrical open circuit exists between the common lead and the normally open lead and an electrical short circuit between the common lead and the normally closed lead. When actuating area 135 is depressed to what is referred to as the actuation point, the electrical states between leads 131 and 132 and between 132 and 133 are flipped, i.e., they are an electrical short circuit and an electrical open circuit respectively. As will be described, in an assembled switch, the switch element is maintained close to its actuation point so that a very small movement of plunger 170 causes the switch element to toggle and change the electrical state between leads 131 and 132 and between 132 and 133.

Switch element cover 120 includes a hole in its top surface 122 for receiving actuator 135 of switch element 130. Switch element cover 120 also incorporates lance or raised portion 123 on to which tab 141 of lever 140 is welded. Lever 140 further includes a spherical button 142 that extends from the underside of lever 140. Lever 140 engages with conical bias spring 150 and counteracting coil spring 160. In the assembled switch, each of these springs provides opposite forces on lever 140.

In the assembled switch, after cover plate 180 is secured to housing 101 via a pair of fasteners that extend through holes 181 and holes 106 in tab 105. When so assembled, conical bias spring 150 is compressed between lever 140 and the underside of cover plate 180 so as to exert a force on lever 140 that is downward with reference to FIG. 2. In this embodiment, conical bias spring 150 and lever 140 can be viewed as a first switch element. This spring force is sufficient to cause spherical button 142 extending from the underside of lever 140 to contact and depress switch actuating area 135 so that the switch would change its electrical state. The spring force provided by conical bias spring 150, however, is opposed by a force provided by coil spring 160 which via skirt 171 of plunger 170 acts on tabs 145 of lever 140. In this embodiment, coil spring 160 and skirt 171 can be viewed as a second switch element. Spring 160 extends between the bottom of housing 101 and a recess (not shown) in plunger 170. To reduce the height or profile of the switch, the longitudinal axes of springs 150 and 160 are offset from one another. In an assembled switch with no external forces acting on plunger 170, the plunger is in its fully extended position. This is the normal state of switch 100 and in this state circumferential skirt 171 on plunger 170 contacts the underside of fingers or pair of extending members 145 of lever 140 and exerts an upward force on the lever tabs. The opposing forces provided by springs 150 and 160 maintains the switch element 130 very close to its actuation point so that a very slight depression of plunger 170 compresses coil spring 150 downwardly in FIG. 2 so that skirt 171 does not contact fingers 145 of lever 140. As a result, the switch actuating area 135 is subject only to the downward force exerted by conical spring and the removal of the upward forces created coil spring 160 causes the switch element to toggle and change the electrical state existing between leads 131 and 132 and between 132 and 133. Accordingly, in the contemplated shipping container application, the closure of the shipping container door depresses the plunger 170 so as to place the switch in a first state and the opening of the container door causes the switch to change from this first state to a second state. Switch 100 advantageously has a housing height of approximately 1.6 centimeters (cm) with a plunger free height above the housing of approximately 1.9 cm. The maximum pre-travel of switch 100 is 2 millimeters (mm) and the total travel of the plunger is 10 mm.

Figure 3:
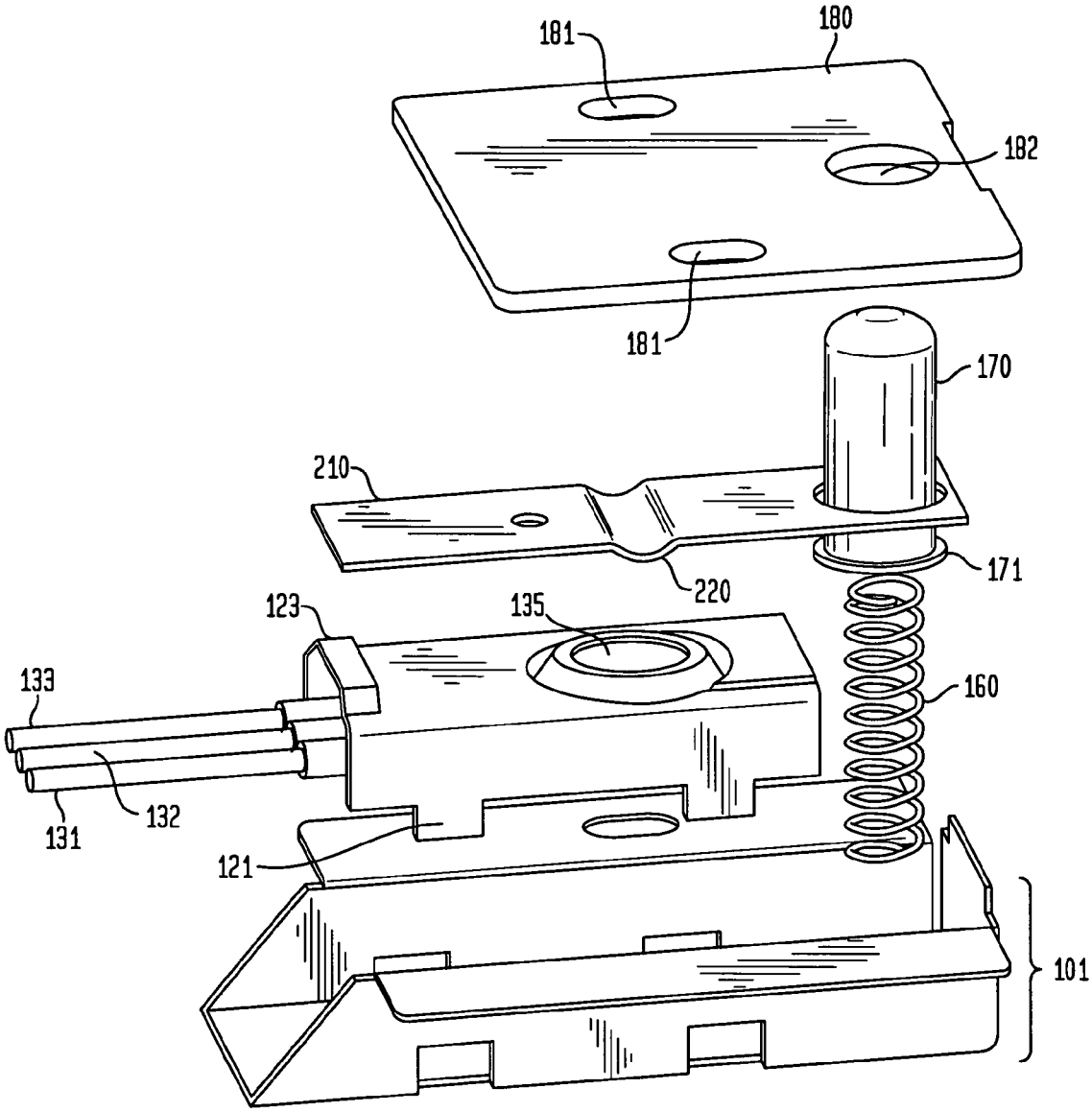
FIG. 3 is an exploded perspective view of the internal elements of the switch shown in FIG. 1 in accordance with a second embodiment of the present invention.

Refer now to FIG. 3 which shows an alternate embodiment for the internal elements of switch 100. As shown in FIG. 3, the conical bias spring 150 of FIG. 2 has been eliminated by a modification of lever 140. Modified lever 210, as with lever 140, is spot welded to lance 123. Lever 210, however, incorporates a knee 220 which depresses switch actuating area 135 in the assembled switch. This knee provides the effect of conical bias spring 150. As in the embodiment of FIGS. 1 and 2, coil spring 160 opposes the downward force exerted by the knee as described in reference to FIGS. 1 and 2. The other elements of FIG. 3 are identical to the identically numbered counterparts in FIGS. 1 and 2. The disadvantage of the embodiment of FIG. 3 is that the formation of the knee and positioning of the lever 210 on lance 210 is critical and considered more difficult to manufacture and maintain over the life of the switch. The switch dimensions and pre-travel and travel characteristics in this embodiment are identical to that described in reference to FIGS. 1 and 2.

It should of course be understood that while the present invention has been described in reference to particular embodiments, other arrangements may be provided by those of ordinary skill in the art without departing from the spirit and scope of the present invention. For example, while the present invention utilizes a plunger element, other elements, including but not limited to a button, roller, or cantilever, can be substituted for the disclosed plunger. Or, for example, while the present invention relates to an electrical switch, the actuating mechanism disclosed could be uses to activate other types of switches, such as an optical switch.

What is claimed is:

1. A device comprising:

a switch including a plurality of terminals and an actuator which when activated causes a change in a state of at least one of the terminals;

a first bias element in an actuating relationship with the actuator and disposed to cause a first bias force exerting on the actuator, the first bias force having a magnitude sufficient to activate the switch;

a second bias element disposed to exert a second bias force opposing the first bias force, the second bias force having a magnitude sufficient to inhibit an actuation of the switch by the first bias force;

an element disposed to cause a switch actuation force to exert upon the second bias element when the switch actuation force is applied to the element, wherein the switch actuation force opposes the second bias force.

2. The device of claim 1 wherein the first bias element includes a lever in the actuating relationship with the actuator and disposed to exert the first bias force.

3. The device of claim 1 wherein the first bias element further includes a first spring exerting on the lever.

4. The device of claim 3 wherein the second bias element includes the lever and a second spring exerting on the lever.

5. The device of claim 4 wherein the first spring and the second spring each have an axis and the axis of these springs are offset from one another.

6. The device of claim 1 wherein the element comprises a plunger.

7. An actuating device for a limit switch housed within the actuating device, comprising:

a housing, including:

an upper surface defining an opening; and a lower surface;

a lever disposed at least partially within the upper and lower surfaces and disposed to engage an actuator of the switch;

a first spring compressed against an interior of the upper surface and against the lever, the compressed spring exerting a first force on the actuator via the lever sufficient to actuate the switch;

a second spring disposed to exert a second force on the lever opposite the first force; and a plunger extending through the opening and engaging the second spring, wherein an actuating force applied to the plunger reduces the second force exerted on the lever causing the first force to actuate the switch.

8. The switch of claim 7 wherein the housing comprises stainless steel.

9. The switch of claim 7 wherein the plunger includes a skirt that engages with the lever.

10. The switch of claim 7 wherein the plunger defines a recess for receiving the second spring.

11. The actuating device of claim 7 wherein the actuator actuates the switch via a depression of the actuator and wherein the first force and the second force have magnitudes such that the actuator partially depresses without application of the actuating force.

12. A method for operating a limit switch comprising the steps of:

exerting a force on an actuator of the switch via an actuating element, the force having a magnitude sufficient to actuate the switch by depressing the actuator via the actuating element;

exerting an inhibiting force via the actuating element, the inhibiting force having a magnitude sufficient to inhibit the force from actuating the switch while permitting partial depression of the actuator; and applying an actuating force opposite the inhibiting force such that the actuating force overcomes the inhibiting force and completes depression of the actuator via the actuating element.

13. The method of claim 12 further comprising the step of removing the actuating force.

* * * * *